United States Patent [19]

Herro

[11] 4,226,032

[45] Oct. 7, 1980

[54] GOLF SHOE

[76] Inventor: Richard E. Herro, 1472 Pioneer Rd., Joliet, Ill. 60435

[21] Appl. No.: 952,811

[22] Filed: Oct. 19, 1978

[51] Int. Cl.[2] ..... A43B 5/00; A43C 15/00; A63B 55/00

[52] U.S. Cl. ..... 36/127; 36/61; 273/32 C

[58] Field of Search ..... 36/127, 134, 61, 62; 273/32 C

[56] References Cited

U.S. PATENT DOCUMENTS

| | | | |
|---|---|---|---|
| 2,968,878 | 1/1961 | King | 36/61 |
| 3,337,952 | 8/1967 | Stollman et al. | 36/61 |
| 3,951,407 | 4/1976 | Calacurcio | 36/127 |

*Primary Examiner*—Patrick D. Lawson
*Attorney, Agent, or Firm*—George H. Gerstman

[57] ABSTRACT

A golf shoe is provided with a hinged plate connected to the outer edge of the golfer's back shoe which tilts the shoe inwardly when worn by the golfer when the plate is angled with respect to the shoe's sole. A retainer means holds the plate flat against the shoe sole when the plate is not in use. A holding means is provided to hold the plate in the angled position when the shoe tilting is desired.

9 Claims, 6 Drawing Figures

FIG. 1
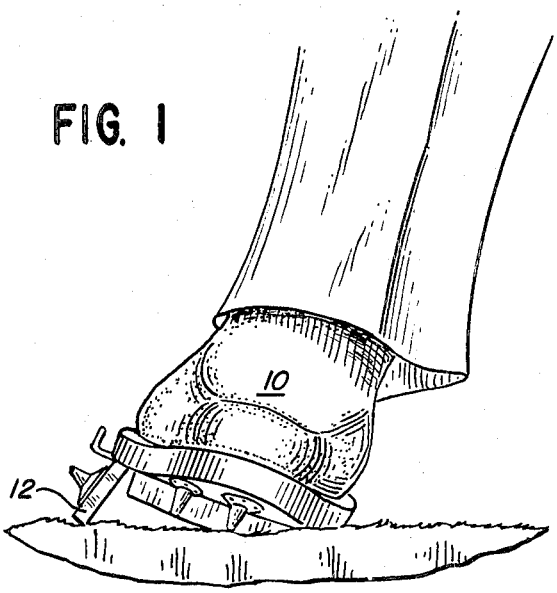
FIG. 1A
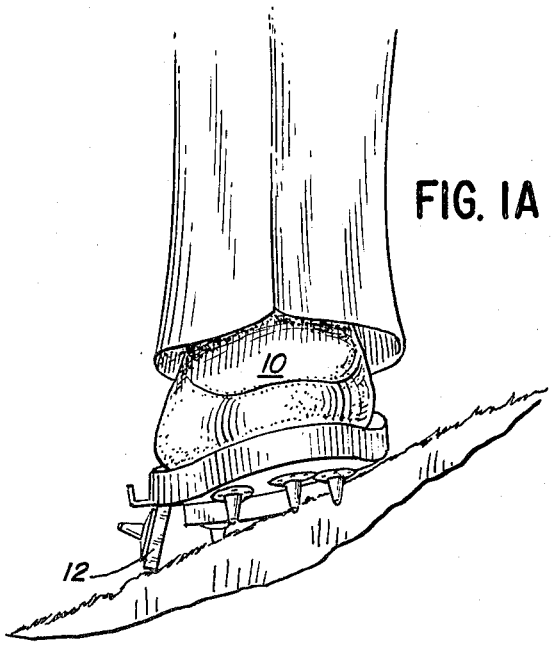
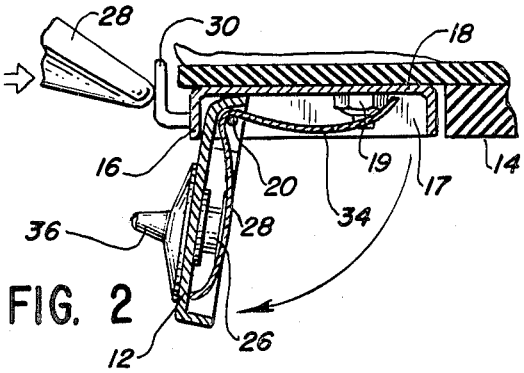
FIG. 2
FIG. 4
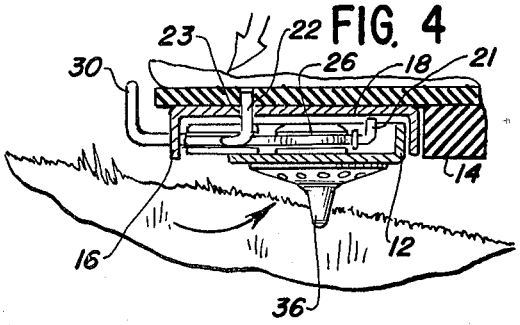
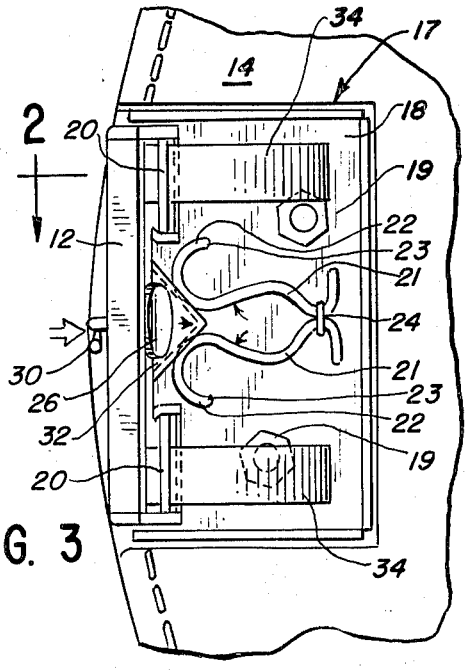
FIG. 3
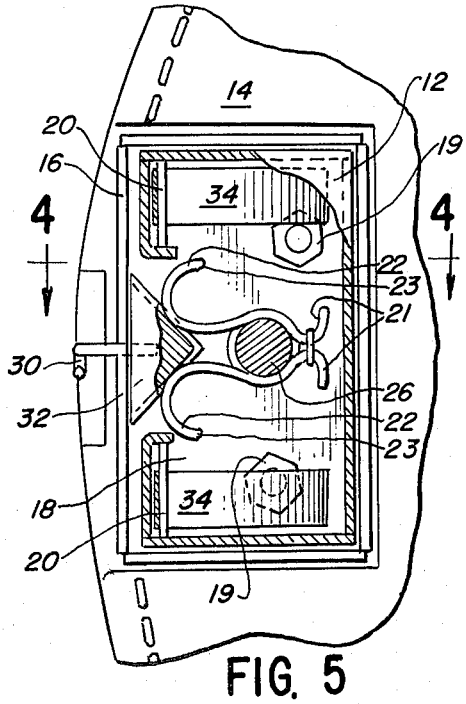
FIG. 5

GOLF SHOE

BACKGROUND OF THE INVENTION

This invention relates to an improved golf shoe which incorporates means to tilt the back shoe of a golfer inwardly.

The back shoe of a golfer is the right shoe for a right-handed golfer and the left shoe for a left-handed golfer. It is desired to tilt the shoe inwardly to prevent the golfer from leaning too far sideways during his swing. By keeping the golfer's weight forward of the backward shoe, the golfer can eliminate "sway" and maintain more stability and balance during his swing than with conventional shoes.

Prior art devices for tilting a golf shoe have included detachable stirrups, removable supporting attachments, separate anchoring blocks, and special molded soles which resist backward roll. These devices require the golfer to either bend over and adjust the mechanism before and after the golf swing or are detachable and must be inserted and removed at each golf swing, or else do not operate to raise the outside of the shoe above a normal position. The present invention alleviates many of the deficiencies of the prior art devices. The present invention is a tilting device which is permanently attached to the shoe and therefore need not be attached and removed and carried separately each time the golfer takes a golf swing. The golfer need not bend over to set up or disassemble the tilting device. A golf club can be used to set up the tilting device, and the tilting device can be folded away merely by turning the shoe in a specified manner. Thus the golfer need not carry around a separate piece or block or have to bend over to set up, remove or retract the device.

It is, therefore, an object of the present invention to provide for a tilting device to be permanently incorporated into a golf shoe. Thus, the golfer need not carry with him separate blocks or wedges.

A further object of the invention is to provide a tilting device that can be set up without having the golfer bend over.

Other objects and advantages of the present invention will become apparent as the description proceeds.

SUMMARY OF THE INVENTION

In accordance with the present invention, a golf shoe is provided with a hinged plate connected to the outer edge of the golfer's back shoe to tilt the shoe inwardly when worn by the golfer. A retaining means is provided to hold the plate flat against the shoe sole when the plate is not in use. A holding means is provided to hold the plate in an angled position with respect to the shoe sole to hold the shoe stable when it is being tilted.

In the illustrative embodiment, the plate is provided with an ordinary golf cleat which extends from the outside face of the plate and with a peg mounted on the inside face of the plate. The shoe sole contains a catch fastener which receives the peg and thereby holds the plate flat against the sole. The part of the shoe sole where the plate lies is cut away so that the outside face of the plate is generally in the same plane as the golf shoe sole when the plate is fastened flat to the sole.

The plate includes a release means which releases it from the sole surface and allows it to angle away from the shoe sole when an object such as a golf club strikes the release means. The plate is held in the angled position by way of a flange which extends from the shoe sole and engages the plate generally along its hinged side. The golfer can move the plate from the angled position to a fastened position by sliding the shoe laterally outward and then lowering the shoe keeping the shoe sole substantially parallel with the ground until the cleats on the shoe sole are in contact with the ground. The fastener will then engage the peg on the inside face of the plate and hold the plate there until the plate is released.

A more detailed explanation of the invention is provided in the following description and claims, and is illustrated in the accompanying drawings.

BRIEF DESCRIPTION OF THE DRAWINGS

FIG. 1 is a front elevational view of a back golf shoe constructed in accordance with the present invention, with the tilting device being in an angled or tilted position with respect to the shoe sole;

FIG. 1A is the same as that in FIG. 1, except that the golf shoe is positioned on an uphill sloping down to the left;

FIG. 2 is a sectional elevation of the tilting mechanism shown after a golf club has hit the release pin, such section being also that taken along line 2—2 shown in FIG. 3;

FIG. 3 is a bottom plan view of the tilting device of FIG. 1;

FIG. 4 is a front sectional elevation of the golf shoe showing the golf tilting means in a closed position flat against the shoe sole, such section being also that taken along line 4—4 of FIG. 5; and FIG. 5 is a bottom plan view of the golf tilting device shown in a closed position with the plate flat against the shoe sole, the plate being partially cut away to show the interior.

DETAILED DESCRIPTION OF THE ILLUSTRATIVE EMBODIMENT

Referring now to the drawings, there is shown in FIG. 1 a shoe 10 constructed according to the invention. A hinged plate 12 is shown angled with respect to the shoe sole 14. Plate 12 is held in an angled position by flange 16 as shown in FIG. 2, thereby preventing the plate 12 from exceeding a predetermined obtuse angle with respect to the shoe sole 14. Such a position of plate 12 supports the outer edge of the shoe 10 so that the shoe is tilted inwardly on level ground as shown in FIG. 1. As shown in FIG. 1A, the shoe is supported by plate 12 and thereby keeps the shoe from rolling downhill when the golfer is playing an uphill lie shot.

A mounting box 17 is first mounted to the shoe sole 14 after part of the sole is cut away so that when plate 12 is in the first position the outside surface is in generally the same plane as the surface of shoe sole 14. Mounting box 17 contains a sole plate 18 which is mounted in firm contact with the shoe sole by means of two conventional machine screws or bolts secured by nuts 19 as shown in FIG. 3. Flange 16 is the outward side of the mounting box 17. In its preferred form, mounting box 17 and plate 12 are made of aluminum sheet metal which is easy to fabricate and resists corrosion.

As shown in FIG. 3, a hinge means is comprised of two hinges 20 which mount plate 12 to mounting box 17 and allow the plate to pivot about a line located adjacent the outer edge of shoe sole 14.

As shown in FIGS. 3 and 5, a fastener means includes curvilinear fastener pins 21. One end 22 of each of the fastener pins 21 are received by holes 23 in the sole plate 18 and allow the fastener pins 21 to pivot about the end points 22. A resilient band 24 urges the free ends of the fastener pins 21 together. Fastener pins 20 are adapted to receive peg 26 which is mounted on the inside of plate 12. As shown in FIG. 2, peg 26 is shaped like a spool in that it has a smaller inner diameter than its outside lip 28 and thereby receives fastener pins 21 when plate 12 is in a first position flat against shoe sole 14 as shown in FIGS. 4 and 5. When the plate 12 is in this first position, the outer face of plate 12 is in substantially the same plane as the shoe sole 14 as shown in FIG. 4.

Release means 30 is provided for releasing plate 12 from the first position so it can assume a second position as shown in FIG. 2 where the plate 12 is angled with respect to the shoe sole. To release the fastener means, an object such as a golf club 28, as shown in FIG. 2, strikes release pin 30 which extends from the outward edge of shoe 10. As shown in FIGS. 3 and 5, release pin 30 is connected to wedge 32 which is slidably mounted to sole plate 18 and which receives curved portions of fastener pins 21. The striking of golf club 28 moves release pin 30 and slides wedge 32 to the right with respect to the sole plate 18, as shown in FIG. 3, which causes fastener pins 21 to separate with respect to each other thereby releasing peg 26 which is fastened to plate 12. Two leaf springs 34 bias the plate 12 to the second position, as shown in FIG. 2, when the fastener means releases peg 26. It can thus be seen that the golfer is able to play a shot without having to bend over and a golf club can be used to strike the release means which releases the plate into the second position ready for play.

When the shot is completed and the golfer desires to secure the plate back to the first position, all he need do is slide his shoe laterally outwardly and then press his foot against the ground whereby the fastening means comprising fastening pins 21 will receive peg 26 and hold the outside face of plate 12 in generally the same plane as the outside of shoe sole 14, as shown in FIG. 4.

A golf cleat 36 is mounted on the outside face of plate 12 and extends therefrom. The golf cleat 36 aids the golfer in moving the plate from the second position to the first position since it will contact the ground when the golfer lowers his shoe to engage the fastening means as shown in FIG. 4.

Although an illustrative embodiment of the invention has been shown and described, it is to be understood that various modifications and substitutions may be made without departing from the novel spirit and scope of the present invention.

What is claimed is:

1. A golf shoe which comprises: a plate; hinge means connecting said plate to the outer edge of the golfer's back shoe; means for retaining said plate in a first position wherein said plate lies flat against the shoe sole; and means for holding said plate in a second position wherein said plate is angled with respect to the shoe sole to thereby tilt the shoe inwardly when worn by the golfer while said plate is in the second position, said means for retaining said plate in the first position including a fastener which is operable when the golfer moves the plate from the second position to the first position by applying a normal force to the outside face of said plate by sliding the shoe generally laterally outward and then lowering the shoe keeping the shoe sole substantially parallel with the ground until the cleats on the shoe sole are in contact with the ground.

2. The golf shoe according to claim 1 including release means for releasing the plate from the first position when an object such as a golf club strikes the release means.

3. The golf shoe according to claim 1 incuding a spring means for biasing the plate to the second position.

4. The golf shoe according to claim 1 whereby the means for holding the plate in the second position comprises a flange extending from the shoe sole which engages the plate generally along its hinged side.

5. The golf shoe according to claim 1 whereby a golf cleat is fastened to the plate and extends from the outside face of said plate so as to aid in the engagement of said fastener.

6. The golf shoe according to claim 1 whereby the outside face of said plate is in generally the same plane as the golf shoe sole when the plate is in the first position.

7. A golf shoe which comprises: a plate; hinge means connecting said plate to the outer edge of the golfer's back shoe; a fastener for retaining said plate in a first position wherein said plate lies flat against the shoe sole so that the plate's outside face is generally in the same plane as the shoe sole contiguous to the plate; a flange extending from the shoe sole which engages the plate generally along its hinged side when the plate is in a second position wherein said plate is angled with respect to the shoe sole to thereby tilt the shoe inwardly when worn by the golfer when said plate is in the second position; a release pin that releases the plate from the first position when an object such as a golf club strikes said release pin; a spring which biases the plate to the second position when the fastener is released; a plate cleat which is fastened to the plate and extends from the outside face of said plate wherein the golfer can move the plate from the second position to the first position merely by applying a normal force to the outside face of said plate by sliding the shoe generally laterally outward and then lowering the shoe keeping the shoe sole substantially parallel with the ground until the cleats on the shoe sole are in contact with the ground.

8. The golf shoe according to claim 7 wherein the fastener comprises: a peg mounted on the inside face of said plate; a set of two generally curvilinear fastener pins generally parallel and fixed at one end and adapted to receive said peg when said plate is in the first position; an elastic band which urges the two said fastener pins together at the free end of said fastener pins so as to grip the peg when the plate is in the first position; a wedge which receives said release pin and which is adapted to slide and thereby separate the two fastener pins so as to release the peg and allow the plate to move to the second position when an object such as a golf club strikes said release pin.

9. The golf shoe according to claim 8 wherein the release pin extends from the outside edge of the golf shoe so as to enable the golfer to strike the release pin with a golf club while keeping the golf shoe sole substantially parallel and in close proximity to the ground.

* * * * *